US005788608A

United States Patent [19]

Wilkinson

[11] Patent Number: 5,788,608

[45] Date of Patent: Aug. 4, 1998

[54] MULTI PURPOSE EXERCISE/SPORT POLES WITH MANY OPTIONAL ATTACHMENTS AND A METHOD OF EXERCISING

[75] Inventor: William T. Wilkinson, P.O. Box 73, Salem, N.J. 08079

[73] Assignee: William T. Wilkinson

[21] Appl. No.: 690,575

[22] Filed: Jul. 31, 1996

Related U.S. Application Data

[63] Continuation-in-part of Ser. No. 341,013, Nov. 17, 1994, Pat. No. 5,628,713, which is a continuation-in-part of Ser. No. 301,069, Sep. 6, 1994, Pat. No. 5,400,825, which is a continuation-in-part of Ser. No. 941,304, Sep. 4, 1992, Pat. No. 5,586,957, which is a continuation-in-part of Ser. No. 200,916, Feb. 22, 1994, Pat. No. 5,443,435, which is a continuation of Ser. No. 846,053, Mar. 5, 1992, abandoned.

[51] Int. Cl.[6] ..... A63B 71/00

[52] U.S. Cl. ..... 482/51; 482/74

[58] Field of Search ..... 482/51, 74, 126

[56] References Cited

U.S. PATENT DOCUMENTS

| | | | |
|---|---|---|---|
| 83,228 | 10/1868 | Warne . | |
| 605,474 | 6/1898 | Sachs et al. . | |
| 2,275,330 | 3/1942 | Tveten . | |
| 3,371,930 | 3/1968 | Shiga . | |
| 4,062,371 | 12/1977 | Bolen . | |
| 4,218,057 | 8/1980 | Wilson . | |
| 4,316,610 | 2/1982 | Hinds | 482/125 |
| 4,351,348 | 9/1982 | Axton . | |
| 4,510,485 | 4/1985 | Tahara . | |
| 4,571,680 | 2/1986 | Wu . | |
| 4,665,373 | 5/1987 | Hait . | |
| 4,688,788 | 8/1987 | Olufs . | |
| 4,733,861 | 3/1988 | Plunkett, III | 482/125 |
| 4,756,524 | 7/1988 | Cooney . | |
| 4,958,386 | 9/1990 | Louis-Jeune . | |
| 5,031,906 | 7/1991 | Jang | 482/126 |
| 5,149,092 | 9/1992 | Parsons . | |
| 5,246,413 | 9/1993 | Koblick | 482/126 |
| 5,267,929 | 12/1993 | Chen | 482/126 |
| 5,308,299 | 5/1994 | Winston | 482/126 |

FOREIGN PATENT DOCUMENTS

| | | |
|---|---|---|
| 2407464 | 8/1975 | Germany . |

OTHER PUBLICATIONS

Article published in "Walking Magazine", Dec. 1991, entitled The Ten Best Walking Workouts, by Rob Sweetgall, pp. 29–37, 64, 66.

USA Today, Advertisement for Nordic Track, Sep. 28, 1992, p. 12A.

Cascade Design, Inc. Brochure, "Sherlock Walking Staff", (1991).

*Primary Examiner*—Lynne A. Reichard

*Attorney, Agent, or Firm*—Connolly & Hutz

[57] ABSTRACT

An adjustable or non-adjustable exercise device having at least one shaft. It is also possible to attach weights, an electronics package, an offset or removable tip to the exercise device. A method of exercising with the exercise device.

34 Claims, 11 Drawing Sheets

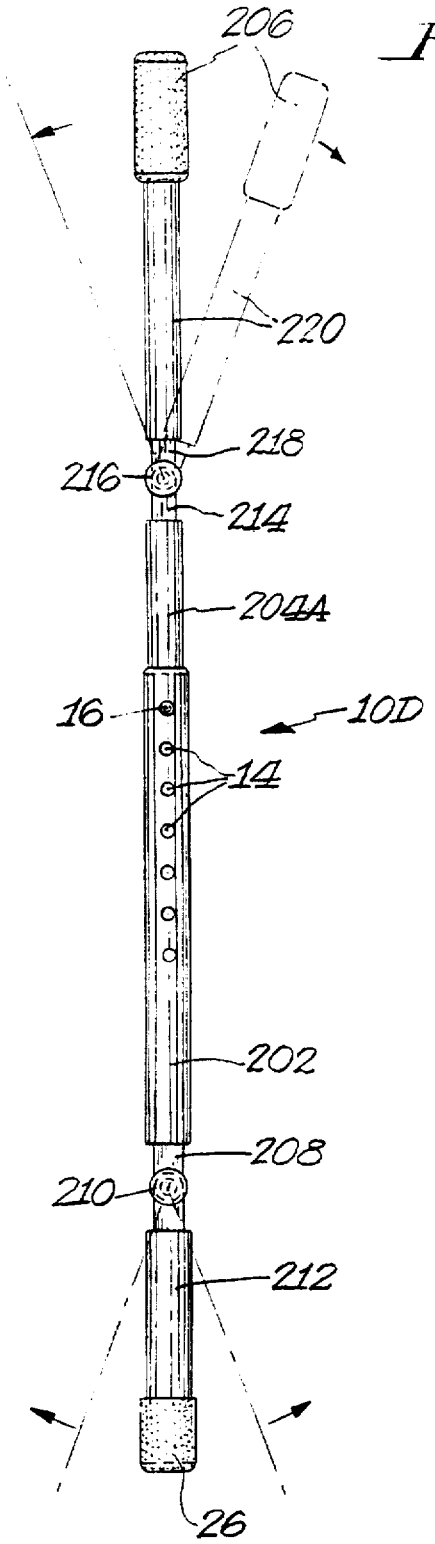
Fig. 23.
Fig. 24.
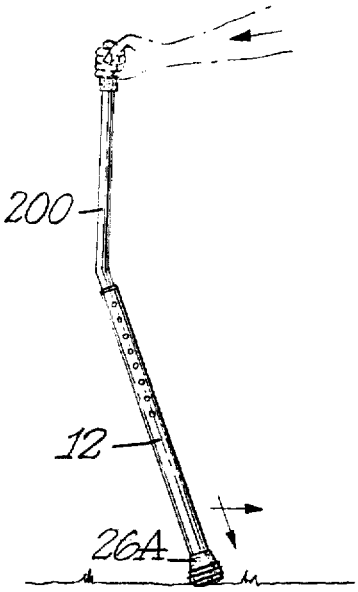
Fig. 25.
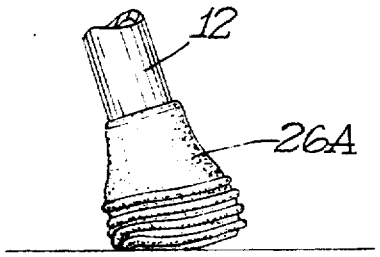
Fig. 26.
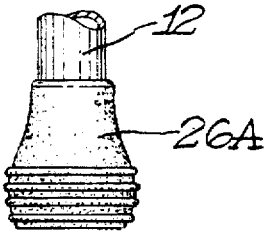

MULTI PURPOSE EXERCISE/SPORT POLES WITH MANY OPTIONAL ATTACHMENTS AND A METHOD OF EXERCISING

This is a continuation-in-part application of Ser. No. 08/341,013 filed Nov. 17, 1994, now U.S. Pat. No. 5,628,713 which is a continuation-in-part application of Ser. No. 08/301,069 filed Sep. 6, 1994 (U.S. Pat. No. 5,490,825), which is a continuation-in-part application of Ser. No. 07/941,304 filed Sep. 4, 1992, now U.S. Pat. No. 5,586,954 and which is a continuation-in-part application of Ser. No. 08/200,916 filed Feb. 22, 1994 (U.S. Pat. No. 5,443,435), which is a continuation application of Ser. No. 07/846,053 filed Mar. 5, 1992 (now abandoned).

BACKGROUND OF THE INVENTION

The exercising industry is a growing industry. There is always a need for exercise devices that are economical and can be used in a number of different of exercises. In addition, it is preferable if the exercise device is light weight and can be easily transportable. There is also a need for a new method of exercising.

U.S. Pat. No. 4,688,788 issued to Olufs addresses the need for an exercising pole for walking. However, there are some problems with Olufs' pole. The weight is forced inside the hollow core near the grip.

U.S. Pat. No. 4,756,524 issued to Cooney addresses an exercise device, used in pairs to simulate cross-country skiing. The poles are adjustable in height. However, the poles are straight and do not disclose nor teach the novel locking mechanism to adjust the height of the poles as described by the us.

SUMMARY OF THE INVENTION

An object of this invention is to provide an adjustable or non-adjustable exercise device in the form of a pole or poles that can be used for exercises such as, but not limited to floor exercises, stepping exercises, dancing exercises, walking, roller blading, roller skating, jogging, skiing, skate boarding, aerobics, hiking, mountain climbing, fishing, golfing, etc.

Another object of this invention is to have at least one bend in the exercise device to allow the exercise device to be planted in a desired location when the user engages the device.

Another object of this invention is to have an improved locking mechanism for adjusting the height of the poles.

Another object of this invention is to have an easy to use adjustment mechanism for the poles.

Another object of this invention is to have a curved sided foot having a flat bottom wherein the curved side can contact the ground.

Another object of this invention is to have weights placed at the bottom of the exercise device.

Another object of this invention is to have weights placed at the top of the exercise device.

Another object of this invention is to have a series of slug weights placed inside the hollow shaft of the exercise device.

Another object of this invention is to have weights placed on the outside of the exercise device.

Another object of this invention is to have an electronics package connected to the handle.

Another object of this invention is to have a method of exercising (dancing, stepping, floor exercises, etc) using at least one exercise device according to this invention.

Another object of this invention relates to a method of storing or carrying at least one exercise device comprising inserting at least one exercise device inside a sling, quiver, or carrying case or attaching a strap to said walking stick.

The exercise device is used primarily for various sports/exercise. The exercise device can be used for other activities by attaching a different type of attachments to the bottom of the exercise device.

In accordance with this invention the exercise device is in the form of a pole which can serve various purposes while engaging in an activity such as:

a) exercise for upper body/arms, b) balance, c) support, weight bearing reduces leg pressure, rehabilitation (like a cane), and d) protection—to fend off an attacker (animal or human).

BRIEF DESCRIPTION OF THE DRAWINGS

FIG. 23 is a side-elevational view of a further alterative embodiment of a device according to this invention having an upper and lower rotatable shaft to adjust the shaft's off-set;

FIG. 24 is a side-elevational view of a further alternative embodiment of a device showing a ground engagement of the pole tip;

FIG. 25 is an enlargement view of the ground contact shown in FIG. 24;

FIG. 26 is an enlarged side-elevational view of the ground contact shown in FIG. 24;

A DETAILED DESCRIPTION OF THIS INVENTION

Figure 1:
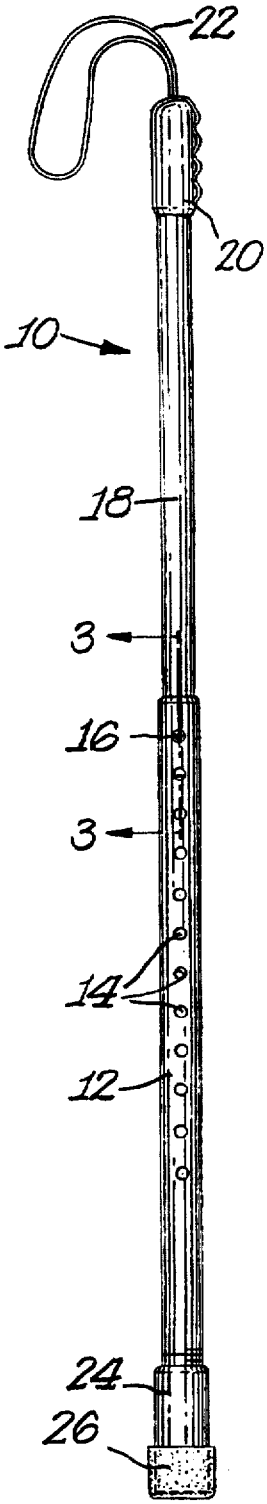
FIG. 1 is a side elevational view of an exercise device in accordance with this invention.

FIG. 1 illustrates an exercise device 10 in accordance with this invention. Device 10 is useful for various types of exercise programs. Advantageously, the device 10 can be used by numerous individuals of different sizes and ages in accordance with different exercise needs. This is possible in part from the dimensional adjustability of the different components forming device 10.

The general device 10 includes a hollow outer tubular shaft 12, which forms a main component of this device. The hollow tubular shaft 12 can be made from any material such as, but not limited to a suitable metal or plastic. The hollow tubular shaft 12 has a series of aligned holes 14. The bottom of the hollow tubular shaft 12 can be threaded. A telescopic inner shaft 18 having a smaller diameter than the hollow outer tubular shaft 12 fits inside the hollow tubular shaft 12. The telescopic shaft 18 can be solid or hollow and can be made of any material such as but limited to plastic or metal. At the bottom of the telescopic shaft 18 is a spring button lock 16 which selectively fits inside the series of aligned holes 14 to lock the telescopic shaft 18 in a fixed position. A handle 20 fits over the telescopic shaft 18. The handle 20 is contoured and can be made of any material such as rubber, plastic or foam. The handle also has a strap 22 fixed to its top as shown in FIG. 1. The strap can be adjustable. Screw-on weight 24 is attached to the bottom of the hollow tubular shaft 12 or the top of the telescopic shaft 18. Screw-on weight 24 can be of any weight. The preferred weight would range from half of a pound to ten pounds. Attached to the bottom of the screw-on weight 24 is a foot 26. The foot 26 can be a non-slip foot made of any material such as rubber or plastic.

Figure 2:
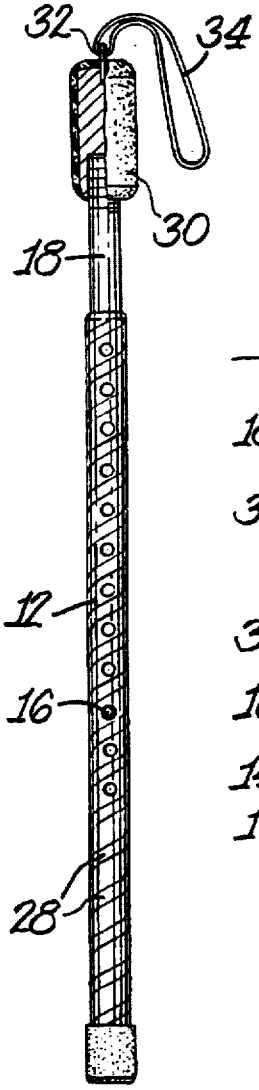
FIG. 2 is a side elevational view partly in section of a further exercise device in accordance with this invention.

FIG. 2 shows the device 10 of FIG. 1 with reflective tape 28 wrapped around the hollow tubular shaft 12 and telescopic shaft 18. In addition, the telescopic shaft 18 is preferably threaded at its top. Screw-on weight 24 is be screwed onto the top of the telescopic shaft 18. A foam handle 20 is placed over the top of the screw on weight 24. An eyelet 32 is attached to the screw on weight 24. A strap 34 extends through the eyelet 32. The strap 34 can be adjustable or fixed. A foot 26 is placed at the end of the hollow tubular shaft 12.

Figure 3:
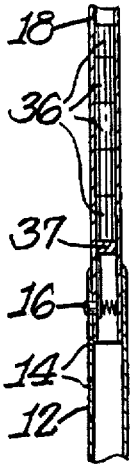
FIG. 3 is a cross-sectional view taken along the line 3—3 of FIG. 1.

FIG. 3 shows another embodiment of this invention. Small weight slugs 36 are lowered into the telescopic shaft 18. The telescopic shaft 18 is partly hollow with a stop 37 at its bottom. The small weights 36 have a smaller diameter than the telescopic shaft 18 and are dropped into the telescopic shaft 18 and stop 37 at the bottom of the shaft. The user could put as many weights in as desired to get the results intended. Alternatively a material such as a liquid or sand may be poured into the telescopic shaft 18 to act as a weight.

Figure 4:
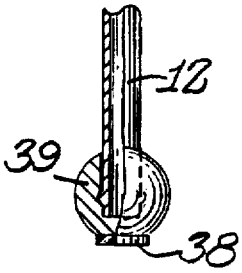
FIG. 4 is a fragmental cross-sectional view of an alternate weight attachment to the exercise device shown in FIG. 1.

FIG. 4 is a fragmental cross-sectional view of the alternate weight attachment. FIG. 4 shows a snap-on ball weight 39 that is snapped on to the bottom of the hollow tubular shaft 12. The snap-on ball weight 39 can come in different sizes and different weights depending on the desired weight by the user. At the bottom of the snap-on ball weight 39 can be a no slip pad 38.

Figure 5:
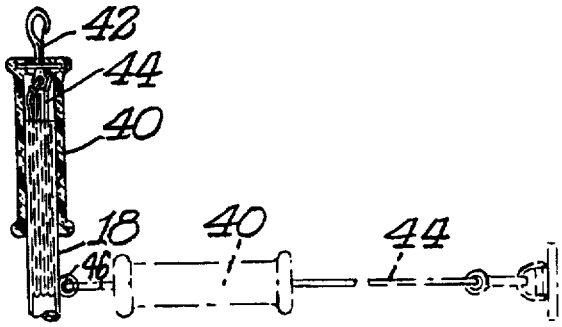
FIG. 5 is a fragmental cross-sectional view of a handle and upper shaft having resistance cords stored in the handle and shaft.

FIG. 5 shows a fragmental cross-sectional view of a handle 40 and telescopic shaft 18 having resistance cords 44 stored in the handle 40 and shaft. In this embodiment the telescopic shaft 18 is hollow as shown in FIG. 5. The handle 40 fits over the telescopic shaft 18. A snap fastener 42 would fit through the handle 40 and inside the telescopic shaft 18.

Resistance cords 44 would be stored inside the shaft 18 and fit on the end of the snap fastener 42. An eyelet 46 is be attached to the telescopic shaft 18, as shown in FIG. 5. As shown in phantom the handle 40 can be removed from the telescopic shaft 18 and the snap fastener 42 can be attached to the eyelet 46 on shaft 18. The resistance cords 44 can be fastened at one end to the snap fastener 42 inside the handle 40 as can be seen in FIG. 5. The other end of the resistance cords then can be attached to anything else such as a snap, belt, etc.

Elastic resistance means could also be attached to the poles to make moving them more difficult and thus generate more exercise. The cords could be anchored anywhere on the body, but preferably at the waist.

Figure 6:
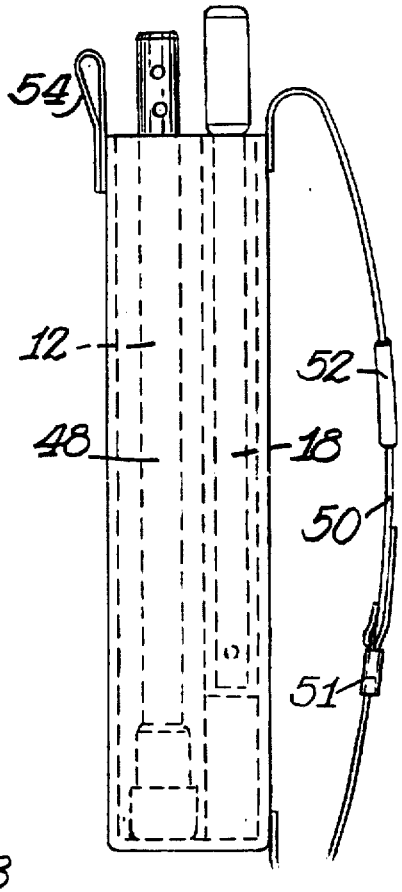
FIG. 6 is an elevational view of a storage case with collapsed shaft sections stored therein.

FIG. 6 shows an elevational view of a storage case with the tubular shaft 12 disconnected from the telescopic shaft 18. The two disconnected shafts are put inside the storage case 48. It would also be possible to fully telescope the shaft 18 inside the tubular shaft 12 for storage purposes. Attached to this storage case 48 is an adjustable strap 50. The adjustable strap 50 is adjusted by sliding the strap through the sleeve 51 and adjusting the strap 50. The adjustable strap 50 can have a shoulder pad on it 52. There can be an optional loop 54 attached to the top of the storage case 48 as seen in FIG. 6 for attachment to a belt.

Figure 7:
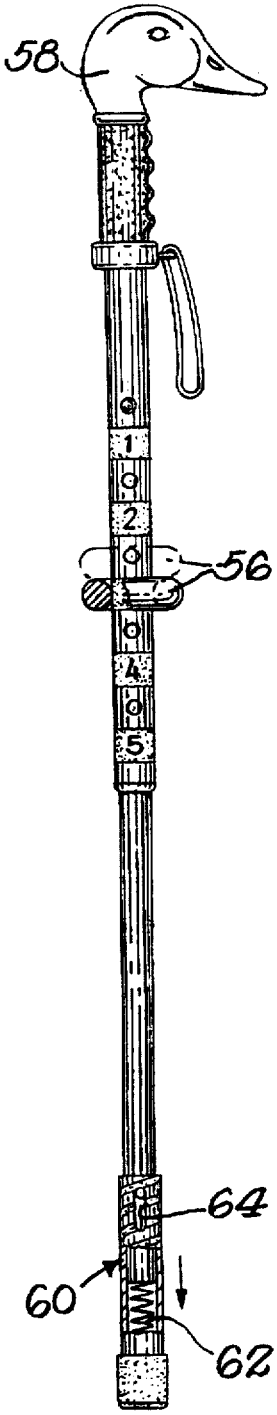
FIG. 7 is a side-elevational view of a further embodiment of an exercise device in accordance with this invention.

FIG. 7 shows a side-elevational view of a further embodiment of a walking stick. In this embodiment outer shaft 12 is shown to be at the top although this aspect of the invention could be practiced with telescopic shaft 18 at the top. Donut weights 56 are fictionally attached to the top shaft 12. The shaft 12 can have a number of colored weight placements as can be seen in FIG. 7. An ornamental knob or handle 58 is attached to the outer shaft 12. A shock absorber spring tip 60 attached to the bottom of the telescopic shaft 18. The shock absorber tip 60 would have a spring biasing means 62 inside the tip. This would allow the walking stick to act as a pogo stick. The shock absorber tip 60 has a pin in slot 64 as shown in FIG. 7. The pin can be turned to engage this spring biasing means 62. A no slip foot 26 is attached at the bottom of the shock absorber tip 60.

The spring biasing means 62 can also be introduced in the various forms of this invention to give the shafts a "pogo stick" or bounces type action to relieve shock and provide a different exercise rhythm. This can be done by placing a spring at the top of the bottom shaft in a shaft attachment stick as shown in FIG. 7. The spring pin on the top of the bottom shaft can be rotated 180° to fall into a slot opposite the adjustment holes on the top shaft. The bottom section can then slide or give, the length of this slot. The spring is anchored to the top shaft (fixed in position) by a pin at the top that engages holes in the top shaft. Thus when weight is put on the exercise device, the bottom shaft moves upwards and compresses the resistance spring for the desired effect. Tension can be varied by having a) different size/length springs, and b) having a series of vertical adjustment holes to engage the spring pin at different levels.

Figure 8:
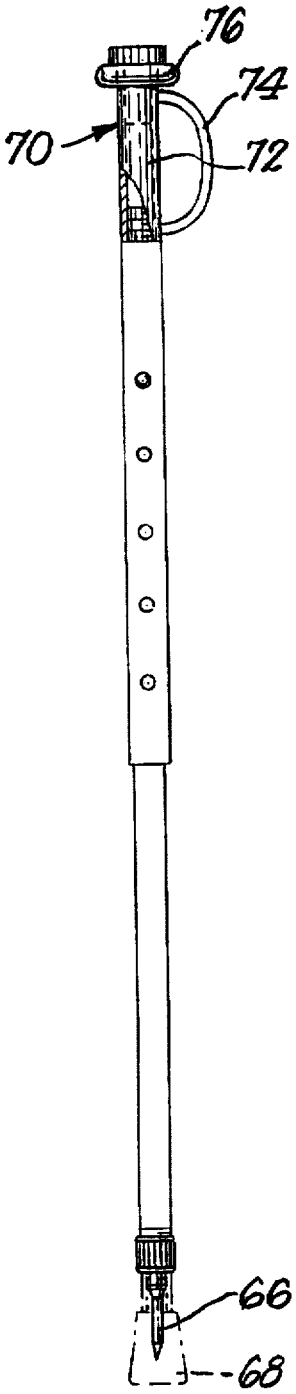
FIG. 8 is a side-elevational view of a still further embodiment of an exercise device according to this invention.

FIG. 8 shows a side-elevational view of another embodiment of a walking shaft. A screw-on hiking pick/trash spear 66 is attached such as by being screwed to the bottom of the lower shaft 18 where the shafts are arranged as in FIGS. 1–2 outer shaft 12 is the lower shaft. A screw-on tip 68 can be screwed on to the bottom of the hiking pick thereby covering up the point. A dumb bell weight 70 is attached to the top of the outer shaft 12. A dumb bell weight 70 consists of a dumb bell grip 72, a dumb bell strap 74 and a dumb bell weight 76. The dumb bell grip 72 is attached to the shaft 12. The dumb bell strap 74 is attached to the dumb bell grip 72. The dumb bell weights sit above the dumb bell strap and are attached to the very top of the shaft 12. Additional weights can be placed on the shaft 12.

Figure 9:
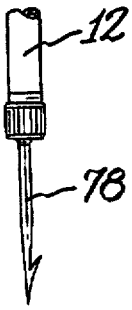
FIG. 9 is a side-elevational view of fishing gaff attachment to the lower section of an exercise device according to this invention.
Figure 10:
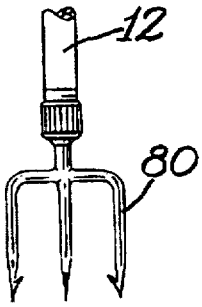
FIG. 10 is a side-elevational view of frogging gaff attachment to the lower section of an exercise device according to this invention.
Figure 11:
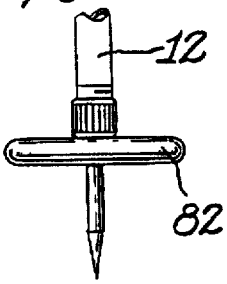
FIG. 11 is a side-elevational view of a ski pole attachment to the lower section of an exercise device according to this invention.

FIGS. 9 through 11 show different attachments that can be placed at the bottom of the lower shaft. FIG. 9 shows a fishing gaff 78. FIG. 10 shows a frogging gaff attachment 80. FIG. 11 shows a ski pole attachment 82. It is also possible attach different golf club heads to the bottom of the lower shaft.

Figure 12:
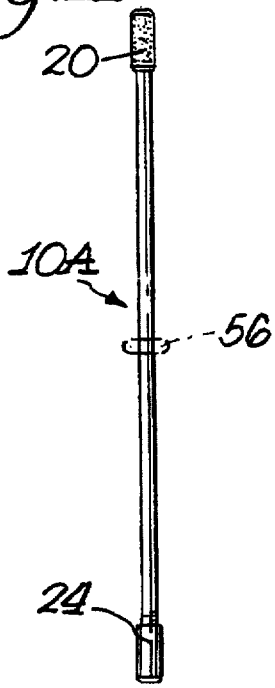
FIG. 12 is a side-elevational view of a still further embodiment of an exercise device in accordance with this invention.

FIG. 12 shows the exercise device 10A. The exercise device 10A consists of a shaft 11 which can be solid or hollow. The shaft 11 is not adjustable. The shaft 11 can be made from any material and ranges from a height of about 24 inches to about 72 inches, and preferably from about 36 inches to about 60 inches. A screw-on weight 24 is attached to the bottom of the shaft 11. A handle 20 is attached to the top of the shaft 11. A donut weight 56 is shown in phantom attached to the middle of the shaft 11.

Figure 13:
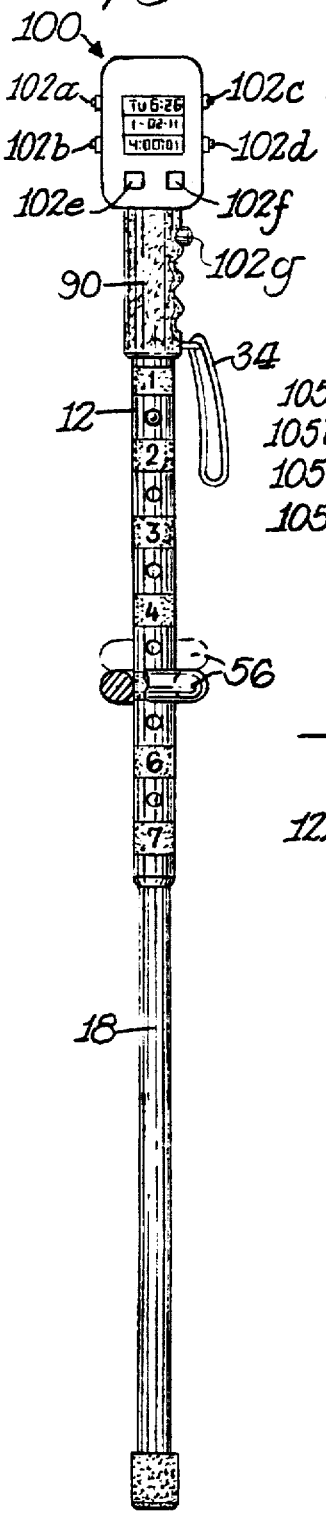
FIG. 13 is a side-elevational view of a still further embodiment of an exercise device in accordance with this invention.

FIG. 13 shows a side-elevational view of a further embodiment of an exercise device in accordance with this invention. In this embodiment outer shaft 12 is shown to be at the top although this aspect of the invention could be practiced with telescopic shaft 18 at the top. Donut weights 56 are fictionally attached to the top shaft 12. The shaft 12 can have a number of colored weight placements as can be seen in FIG. 13. A handle 90 is attached to the outer shaft 12. An electronic package 100 is attached to the top of the handle 90. As later described the electronics package 100 can take various forms. A suitable electronics package would display the time, the day and date, the distance traveled, a pulse meter, also have a stopwatch, an alarm, an hour beeper and a light. The electronics package 100 would have a series of buttons 102 (*a–f*) which would activate the various functions as can be seen in FIG. 13. A mechanism for the electronics package would be the same as found on sports watches. In addition, a beeper 102*g* can be connected to the pole on the handle 90. The user could press the beeper 102*g* in the grip of the handle 90 which could engage the beeper. The beeper 102*g* can omit a high pitched sound which could be similar to that of a dog whistle, which would effectively chase away animals, such as dogs, from the user.

Figure 14:
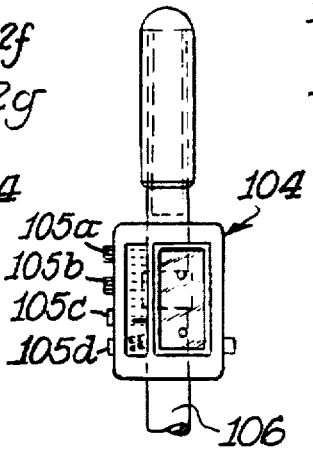
FIG. 14 is a side-elevational view of a cassette radio attachment to the upper section of the exercise device according to this invention.

FIG. 14 shows another type of electronics package 104 that can be used with this invention. This electronic package would include an am/fm cassette radio 104 that can be attached to the upper shaft of the waling device. There would be a series of buttons/dials 105(*a–d*) that would operate the various functions. For the cassette there would be fast forward, reverse, play, record, and volume control. For the radio the functions would include channel selection, am or fm selection and volume control. This can be mounted by brackets on the outside of the tape player to the upper shaft 106. In addition a compact disc player could be mounted the same way to the upper shaft 106.

Figure 15:
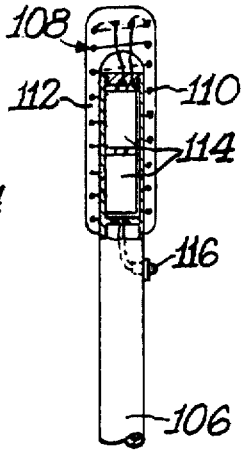
FIG. 15 is a side-elevational view of a heating attachment to the upper section of the exercise device according to this invention.

FIG. 15 shows a heating mechanism 108 attached to the outside of the upper shaft 106. The heating mechanism 108 would consist of heating coils 110 attached to the upper shaft 106 and to the inside of the handle 112. Batteries 114 would be placed in the upper shaft 106. The handle 112 would be placed over the heating coils and thereby when the user grasp the handle, the user can turn a switch 116 and activate the heating coils thereby causing heat to be generated to keep the user's hands warm.

Figure 16:
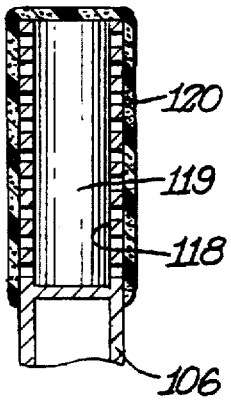
FIG. 16 is a side-elevational view of a cooling attachment to the upper section of the exercise device according to this invention.

FIG. 16 shows a side-elevational view of a further embodiment of a walking device. The upper shaft 106 can be hollow and have a storage compartment 118. Cold packs or chemicals 119 can be placed inside the storage compartment 118. Over the shaft 106 can be placed a handle 120 perforations around the perimeter made of high porosity foam cover to keep the user's hands cool during the summer time.

Figure 17:
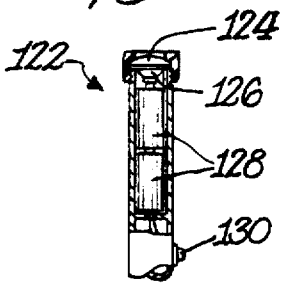
FIG. 17 is a side-elevational view of a light attachment to the upper section of the exercise device according to this invention.

FIG. 17 shows a side-elevational view of a further embodiment of the walking stick. As shown therein a flashlight 122 consisting of a lens 124, a bulb and reflector 126 and a set of batteries 128 is mounted to the walking stick. These attachments can be placed at the top or at the bottom of the walking stick. FIG. 17 shows the flashlight at the bottom of the walking stick. The flashlight would be activated by turning on the switch 130. The flashlight switch could be set up to have a blinking capability. The flashlight on the walking stick would allow the user to use the stick in the night.

Figure 18:
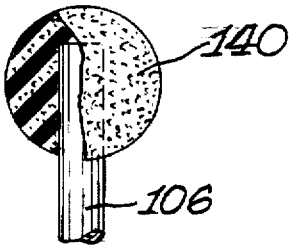
FIG. 18 is a side-elevational view of a hand grip attached to the exercise device according to this invention.

FIG. 18 shows a side-elevational view of a further embodiment of the walking stick. As shown therein is a handle 140 attached to the shaft 106. The handle 140 would be made of a resilient material such as but not limited to rubber. The handle shown is spherical in shape but it could other shapes. The user would be able to perform hand strengthening exercises by griping the handle tightly and releasing and then regripping.

Figure 19A:
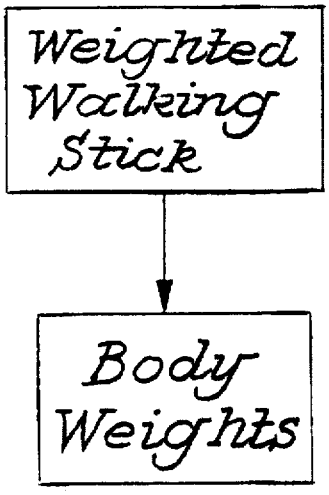
FIGS. 19*a* and 19*b* are flow charts of a process of using an exercise device according to this invention.
Figure 19B:
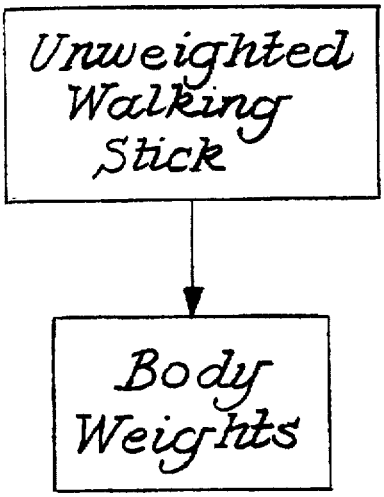

FIG. 19 shows a flow diagram of different possible ways of using the walling stick. FIG. 19*a* shows that the walking stick may be weighted and the person may also use body weights such as hand, ankle, glove, vest, shoe or belt weights. The person exercising would engage in a routine with the weighted walking stick and body weights. FIG. 19*b* shows an unweighted walking stick and the person would use body weights during the users exercise routine. The possible way to exercise is just using a weighted walking stick.

Figure 20:
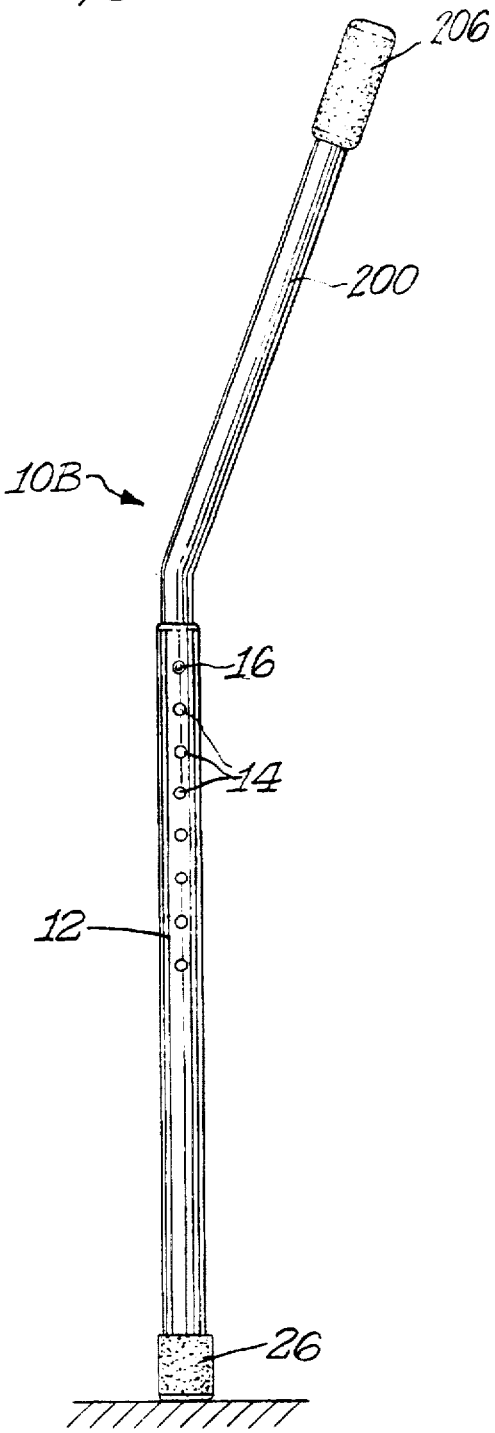
FIG. 20 is a side-elevational view of a device according to this invention having an off-set shaft.

FIG. 20 shows a side-elevational view of another embodiment of an exercise device having an off-set shaft according to this invention. The exercise device 10B includes a hollow outer tubular shaft 12, which forms the main component of this device. The hollow tubular shaft 12 is described in FIG. 1. The hollow tubular shaft 12 can have series of aligned holes 14. A non-slip foot 26 can be on the bottom of the tubular shaft 12. It is also possible that the non-slip foot 26 can be angled such that when the user places the pole down on the ground the pole forms about a 90° angle with the ground. Stated another way, the pole would be perpendicular to the ground. The bottom of the foot could be angled preferably from about 15° to 180° so that when the user places the device at an angle, the device could be about perpendicular to the ground. The telescope shaft 200 can be solid or hollow, can be made of any material such as, but not limited to plastic or metal. The telescopic shaft 200 would have at least one off-set in it forming an angle greater than 90° and less than 270° and preferably from about 140° to about 225°. If the shaft did not have the off-set, then the angle would be 180°. At the top of the shaft 200, could be handle 206 made of any resilient material such as, but not limited to foam. It is also possible that the pole is made of one shaft (see FIG. 12) having at least one bend in the shaft.

Figure 21:
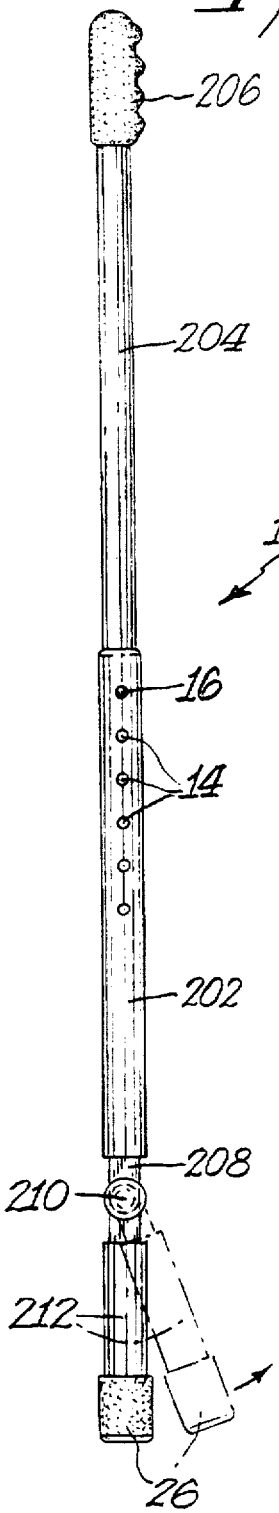
FIG. 21 is a side-elevational view of an alternate embodiment of a device according to this invention having a rotatable shaft to adjust the shaft's off-set.
Figure 22:
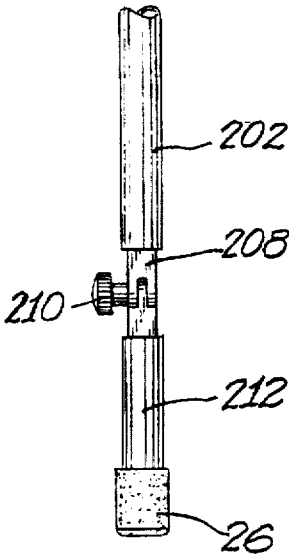
FIG. 22 is a front-elevational view of FIG. 21.

FIG. 21 shows a side-elevational view of a further embodiment of an exercise device having a rotatable shaft to adjust the shaft's off-set. The general device 10C includes a hollow outer tubular shaft 202 which forms the main component of this device. The hollow tubular shaft 202 can be made of any material such as, but not limited to a suitable metal or plastic. The hollow tubular shaft 202 can have a series of aligned holes 14. A telescopic inner shaft 204 having a smaller diameter than the outer tubular shaft 202 could fit inside the hollow tubular shaft 202. The telescopic shaft 204 can be solid or hollow and can be made of any material such as, but not limited to plastic or metal. At the bottom of the telescopic shaft 204, is an adjustable means 16 such as, but not limited to, a spring button lock which selectively fits inside of the aligned holes 14 to lock the telescopic shaft 204 into a fixed position. A handle 206 could fit over the telescopic shaft 204. The handle 206 can be contoured and can be made of any material such as, but not limited to plastic, rubber or foam. The handle 206 can also have a strap fixed to it as is shown in FIG. 1. This strap can be adjustable. Screw-on weights can be attached to the top of the handle as shown in FIG. 1. The tubular shaft 202 can have a smaller solid shaft 208 connected to the bottom of the hollow tubular shaft 202. An adjusting means 210 could be connected to the shaft 208. A lower foot or leg 212 could be connected to the shaft 208 and to the adjusting means 210. The adjusting means 210 can be, but is not limited to a lock-knob or tongue and groove pivot joint as shown in FIG. 22. The knob can be loosened to move the lower leg 212 to the desired angle, then the knob can be turned the opposite direction to tightened the lower leg 212 so the leg could be positioned to the desired angle. On the bottom of the lower leg 212 could be a non-slip contact foot 26.

FIG. 22 shows the adjusting means 210 from FIG. 21. The adjusting means 210 can be a tongue and groove pivot joint. The lock can be tightened to adjust the angle of the offset shaft to the desired location. The angle can be changed depending on which user uses it or the terrain that the user is going up. On a steep hill, the angle could be adjusted for shorter strides when the user goes up hill and adjusted differently for the longer strides when the user goes down hill. The angle could be adjusted so that when the pole is placed down and touches the ground, the pole is actually in a perpendicular position with respect to the ground.

FIG. 23 shows a side elevational view of a further alternative embodiment of an exercise device according to this invention having an upper and lower rotatable shaft to adjust the shafts off-set. As discussed above in FIG. 21, the exercise device can have at least one adjusting means to adjust the off-set of the pole as shown in FIG. 21, or can have at least two adjusting mechanisms to change the off-set of the shaft as shown in FIG. 23. FIG. 23 is the same as FIG. 21 except for the additional rotatable upper shaft 220 and shafts 214 and 218, and adjusting mechanism 216. In FIG. 23, the upper and lower shafts 220 and 212 can be off-set as is described in detail in FIGS. 21 and 22. The off-set can be changed by the adjusting means 210 and 216. This could allow the user to lock the shaft into the desired position. The lock knob shown in 210 and 216 can be turned to lock the shafts 212 and 220 into the desired position. It is also possible to have more than two offsets or more than two adjusting means such as 210 and 216. All of the above embodiments can include an electronics package or weights as described in FIGS. 1 through 19 above.

FIG. 24 shows a side-elevational view of a further embodiment of a walking device. The walking device shown in FIG. 24 is very similar to that which was described in FIG. 20 above. This walking device has a different non-slip foot 26A. The foot 26A can be made of a resilient material such as, but not limited to, rubber.

FIG. 25 shows an enlarged view of the foot 26A making contact with the ground. The foot 26A is shown with annular rings and ground enhancing ribs. The annular rings are compressed when the foot 26A is pushed into contact with the ground, and grips the ground preventing slippage of the pole.

FIG. 26 shows the foot 26A in the non-engaged upright position when the foot 26A is not being engaged into the ground. The foot 26A has a concave surface at the top of the foot closest to the pole. Annular rings go from around the middle of the surface to the bottom of the surface that hits the ground. The ground surface at the bottom of the tip may be flat or may consist of smaller diameter annular rings.

Figure 27:
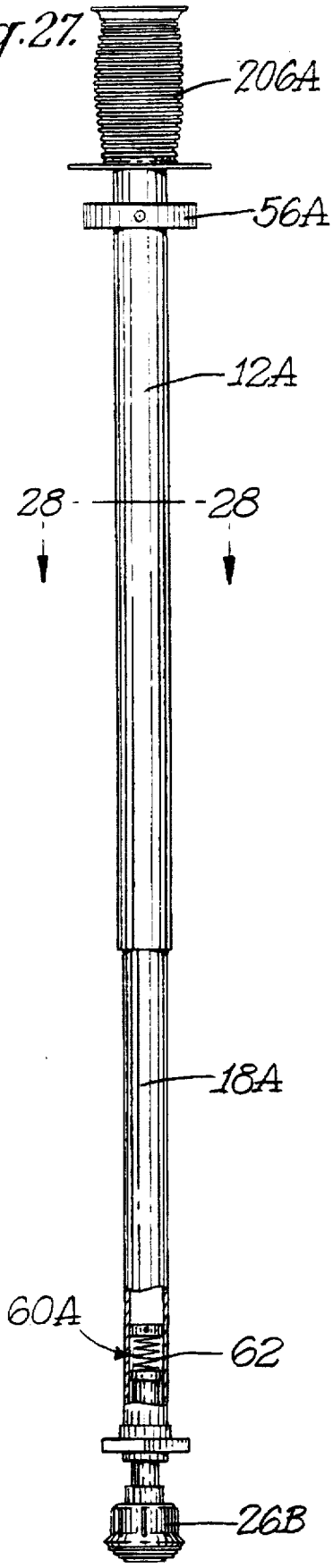
FIG. 27 is a side-elevational view of a still further embodiment of a device according to this invention.

FIG. 27 shows another embodiment according to this invention. The device can have an outer shaft 12A. The outer shaft 12A can be hollow. An inner shaft 18A having a smaller diameter than the outer shaft 12A can fit inside the outer shaft 12A. The locking mechanism of this walking device may be that as described in FIG. 13 above or that as described in FIG. 28 below. A weight 56A can be attached to the outer shaft 12A. The weight 56A may be attached and locked into position by tightening the screws into place as shown in FIG. 27. Also shown in FIG. 27 is a squeezable handle 206A. A user can get a workout by squeezing the resilient handle 206A. The handle 206A can be in a shape that conforms to the hand where the center of the handle 206A can be wider than the top and bottom ends as shown in FIG. 27. The user could squeeze the handle 206A, thereby exercising the hands and the wrists while using the exercise device. At the bottom of the pole can be attached a spring loaded power tip 60A. The spring loaded power tip 60A could have a spring 62 inside said tip and a non-slip foot 26B connected to the spring loaded tip 60A. When the non-slip foot 26B makes contact with the ground, the tip 60A would spring back and give resistance and allow the pole to make better contact with the ground.

Figure 28:
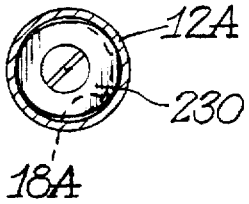
FIG. 28 is a cross-sectional plane view taken along line 28—28 of FIG. 27 showing a novel locking mechanism according to this invention.

FIG. 28 shows a cross-sectional plane view taken along line 28—28 of FIG. 27. The embodiment according to this invention has a turn and twist locking mechanism. A turn and twist locking mechanism has not been used on exercise poles before. The inner shaft 18A can be turned clock-wise and locked into place inside outer shaft 12A. A cam lock 230 is attached inside the inner shaft 18A. The cam lock 230 can provide the vertical adjustment for the pole. The cam lock 230 could be of an offset circular shape thereby having a part of the diameter less than the diameter of the inner diameter of the outer shaft 12A and having another part of the diameter larger than the inner diameter of the outer shaft 12 A. To loosen or adjust the shaft, the inside shaft 18A is turned the opposite direction until it becomes loose thereby freeing shifting the diameter of the cam lock 230 to have the diameter to be significantly less than the diameter of the inner shaft 18A thereby unlocking the pole and allowing the inner shaft 18A and the outer shaft 12A to be moved up or down to the desired height and then locked back into place by twisting the outer or inner pole.

Figure 29:
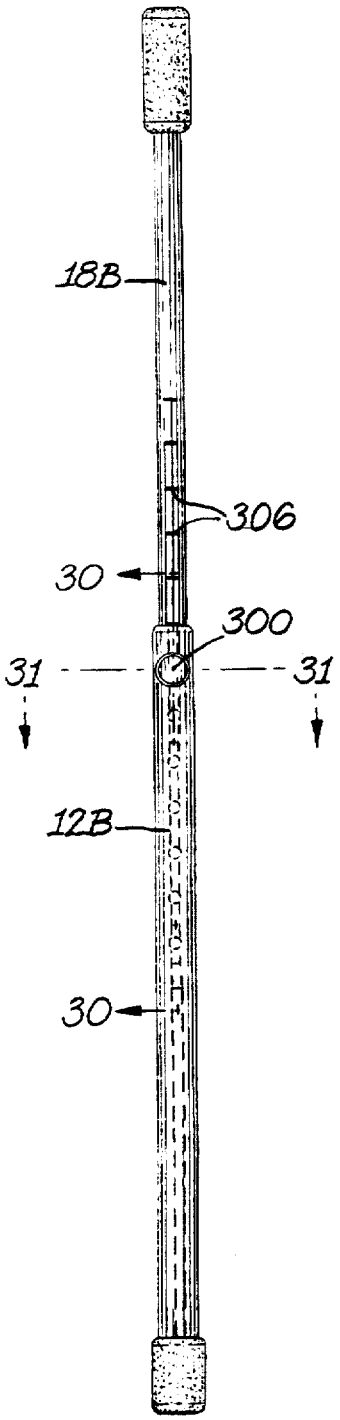
FIG. 29 is a side elevational view of another embodiment of a device according to this invention.
Figure 31:
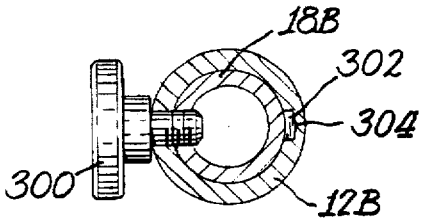
FIG. 31 is a cross-sectional top plan view taken along line 31—31 of FIG. 29 showing a novel locking mechanism according to this invention.

FIG. 29 shows a side elevational view of an exercise stick showing another vertical adjustment mechanism. The inner shaft 18B can be fit inside the hollow tubular outer shaft 12B. The inner shaft 18B and the outer shaft 12B can be made of the same material as the inner shaft 18 and the outer shaft 12. The outer shaft 12B has a series of aligned holes 14B going completely through the shaft. The inner shaft 18B also has a series of aligned holes 14B in the shaft. The aligned holes can be threaded. A locking mechanism such as but not limited to a thumbscrew 300 can fit inside the holes of the outer shaft 12A. The thumbscrew 300 can be turned so that the thumbscrew 300 can also fit inside the inner shaft 18B holes. It is also possible to have an alignment device such as a line going vertically down the inner shaft 18B. The line can be but is not limited to painted or peened (forming an indent in the inner shaft 18B). In addition the line or mark can also be placed over the holes 14B or can partially go down or completely down the inner shaft 18B over the holes 14B. This would allow the user to easily see where the holes are and to align the inner shaft 18B with the outer shaft 12B so that the thumbscrew 300 can be placed through the holes 14B. In addition it is possible to have measurements painted or dyed on the inner shaft 18B. This would allow the user to quickly set two poles to the same desired height. Another method to align the poles can be done by a key way 302 as shown in FIG. 31. The key way 302 could be on the inner shaft 12B and the outer shaft 18B would have a key 304 that would allow the key way 302 to slide through, thereby having the holes always aligned.

Figure 30:
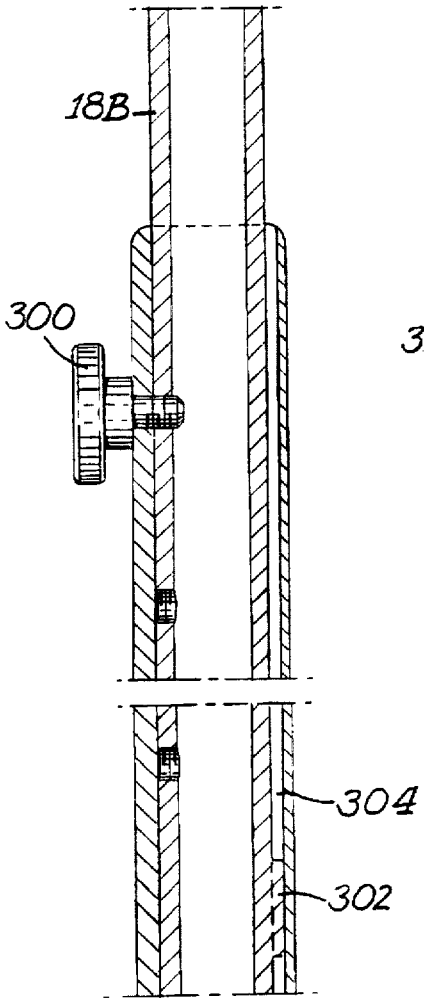
FIG. 30 is a cross-sectional elevational view taken substantially along line of 30—30 of FIG. 29.

FIG. 30 is a cross-sectional elevational view taken substantially along line 30—30 of FIG. 29. FIG. 30 shows the thumbscrew 300 tightened into the pole to lock it into position. Also shown is the alignment done by a key way 302 and key 304 as described in FIG. 29.

FIG. 31 shows a cross-sectional top plane of view taken along 31—31 of FIG. 29. The thumbscrew 300 is screwed inside the outer shaft 12B and the inner shaft 12A. The key way 302 is shown on the outer shaft 18B and the key 304 is shown on the inner shaft 12B.

Figure 32:
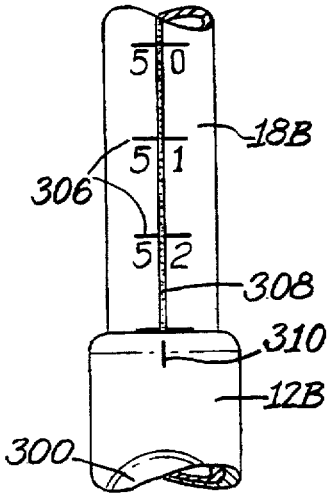
FIG. 32 is an enlarged view of a section of FIG. 29 showing the adjustment marks according to this invention.

FIG. 32 shows a fragmental enlarged side elevational view showing the height adjustment indicia line of FIG. 29. The height indicia lines 306 can be horizontally or vertically marked on the inner tube 18B. There could also be a line 308 going vertically down the inner shaft 18B. The line can be, but is not limited to painted or peened (forming an indent in the inner shaft 18B). In addition the mark or line 308 can also be placed next to or over the holes 14B and/or can partially go down or completely down the inner shaft 18B over the holes 14B. There could also be an optional location marker 310 marked or engraved in the outer shaft 12B in order to more easily align the inner and outer shafts 12B and 18B respectively.

The general device 10C includes a hollow outer tubular shaft 12C which forms a main component of this device. The hollow tubular shaft 12C can be from any material such as, but not limited to a suitable metal or plastic material. A telescopic inner shaft 18C having a smaller diameter than the hollow tubular shaft 12C, fits inside the hollow tubular shaft 12C. The telescopic shaft 18C can be solid or hollow and can be made of any material such as, but not limited to plastic or metal. Preferably, the material is a light-weight material. An adjustment and locking means 400 is attached to the upper end of the telescopic inner shaft 18C. Removable weights 402 can be connected to the outer tubular shaft 12C or the telescopic shaft 18C. Connected to the top of the outer tubular shaft 12C can be a handle 404. The handle 404 can also have a strap 406 connected to the handle 404. The strap 406 can be adjustable and could allow a user to insert his or her hand to grab the handle 404 and prevent the user from dropping the device 10. Again, the strap 406 can be adjustable so that the user can tighten or loosen the strap to the desired position. A non-slip foot 407 can be connected to the bottom of the telescopic shaft 18C. When the non-slip foot 407 makes contact with ground surface, the foot can stay on the surface while the pole is being rotated or moved in direction of movement by the user. The non-slip foot 407 allows the user can push off the surface at the moment the user wants.

Figure 33:
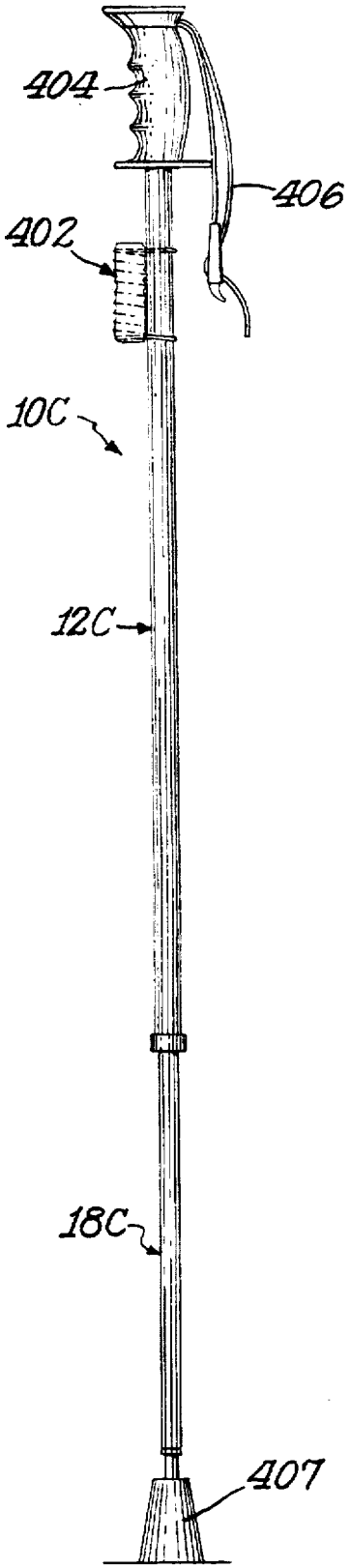
FIG. 33 is a side elevational view of a further embodiment of a device according to this invention.
Figure 34:
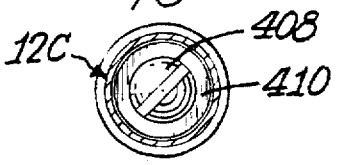
FIG. 34 is an enlarged top plan view of the tip shown in FIG. 33.

FIG. 34 shows the adjusting and locking mechanism 400 according to FIG. 33. The adjusting and locking mechanism 400 can include a means for having two surfaces come together inside the outer tubular shaft 12C, and expand to larger surface diameter than the inner diameter of the hollow shaft 12C thereby forcing the walls of the inner hollow shaft 12 to expand slightly and locking the pole into the desired location. The locking and adjusting means 400 can be accomplished by, but is not limiting to a threaded bolt 408, a bushing 410 which both fit inside the upper hollow shaft 12C. The threaded bolt 408 can be attached to the telescopic shaft 18C at the end that is inserted into the outer tubular shaft 12C. The threaded bolt 408 can be permanently attached so that the bolt 408 is in a fixed position and cannot be moved up or down. The threaded bolt 408 and the bushing 410 are smaller in diameter than the hollow outer tubular shaft 12C. The bushing 410 can have a threaded hole in about the center of the bushing so that the bushing 410 may move up or down on the threaded bolt 408 by turning the bushing 410 or turning or twisting the pole to which is in contact with the bushing 410 and causes the bushing 410 to turn. The threaded bolt 408 and the bushing 410 are connected to the telescopic shaft 18C and fit inside the hollow tubular shaft 12C. The bushing 410 can be cut at an angle diagonally so that about one quarter to about one half of the bushing is removed.

Figure 35:
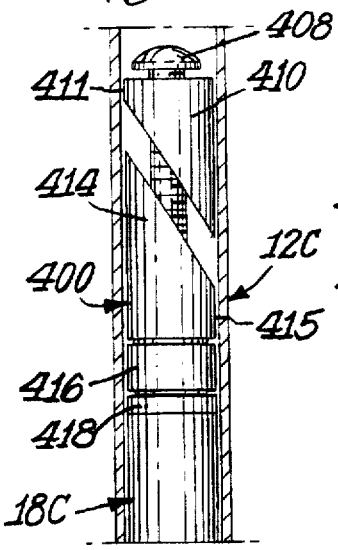
FIG. 35 is an enlarged side elevational view of the locking and adjusting mechanism shown in FIG. 33 not in the engaged position.

FIG. 35 shows a side elevational view of the adjusting the locking mechanism 400 according to FIG. 33 in the unlocked and non-adjusted form. The bushing 410 has a camming surface 412. When the telescopic shaft 18C is turned, the camming surface 412 of the bushing 410 comes into contact or separates from the surface of another bushing 414 which is seated below the threaded bushing 410 on to the bolt 408. The bushing 414 can be at an angle that is different from the angle of the bushing 410 so that when the surfaces of the bushings 410 and 414 come in contact, they form a diameter larger than the diameter of the hollow tubular shaft 12C. The bushing 414 can be made of any material such as, but not limited to, metal, rubber or plastic. In addition, the bushing 414 can have a hole in the center of the bushing. The hole would be greater than the diameter of the threaded portion of the bolt 408. This would allow the bushing 414 to fit on the threaded bolt 408. The size of the surface 411 of the bushing 410 would not be the same size of the surface of bushing 414. For this reason when the bushings 410 and 414 come in contact with each other the combined diameter of the bushings 410 and 414 would be larger than the inner diameter of the outer shaft 12C. In the unlocked and non-adjusted form, the bushings 410 and 414 are not in contact so that the combined diameter of the bushings 410 and 414 is less than the inner diameter of the outer tubular shaft 12C.

Figure 36:
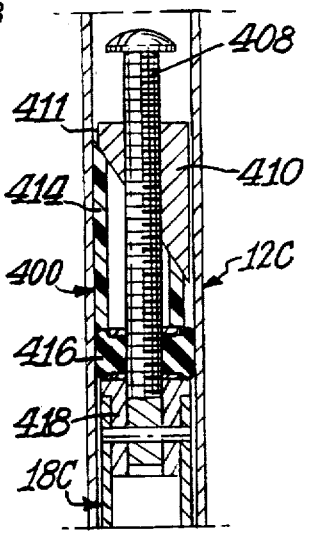
FIG. 36 is an enlarged side elevational view of the locking and adjusting mechanism in the engaged position.

FIG. 36 shows the adjusting the locking mechanism 400 locked into place. The bushing 410 is pressed against the inside of the outer tubular shaft 12C by a camming action between the upper bushing 410 and the lower bushing 414. The total diameter of the locked bushings 410 and 414 once in contact would be slightly larger than the diameter of the inside hollow outer shaft 12C thereby locking the telescoping shaft 18C into the hollow outer shaft. It is also possible to have a grommet or spacer 416 between the bushing lock 414. The grommet 416 could be made of any resilient material such as, but not limited to rubber or plastic. The grommet 416 could act as a stop for the bushing 414 so that when the bushing 414 becomes in contact with bushing 410, the grommet 416 would assert force on the lower end of the bushing 414. There could also be a locking means for locking the bolt 408 into a fixed position in the telescoping shaft 18C. The locking means 418 can be a thread locking bolt (having threads on the outside diameter of the bolt and having threads on the inside diameter of the sleeve 418). The sleeve 418 is inserted into the end of the telescoping shaft 18C. The threaded bolt 408 can be screwed into a fix position by screwing the threaded bolt 408 into the sleeve 418 and the shaft 18C. The sleeve 418 can be fixed into position by pinning, peening or chemically bonding. Again, the locking mechanism 400 can be attached to the upper end of the telescopic shaft 18C. The distance from the top of the bolt 408 to the sleeve 418 would remain the same whether the adjusting means is engaged or not engaged. The twisting of the telescopic shaft 18C would allow the bushing 410 to move up or down the screw. The bushing 410 would be a threaded bushing and can lock into place with the bushing lock 414 by the turning of the telescopic shaft 18C.

Figure 37:
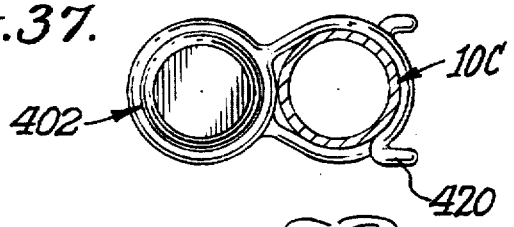
FIG. 37 shows a top plane view the weight of the embodiment of a device according to this invention.

FIG. 37 shows a top plan view of the device according to this invention. FIG. 37 has the weight 402 attached to the device 10C. The weight 402 can be attached by a retainer clip 420.

Figure 38:
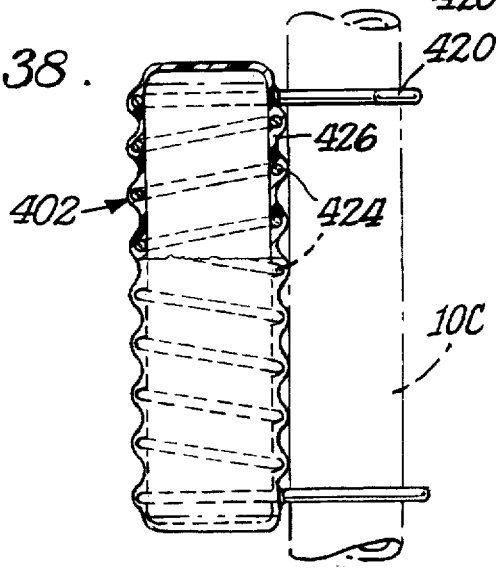
FIG. 38 shows an enlarged side elevational view partially broken away of a weight that can be attached to the device according to this invention.

FIG. 38 shows an enlarged view of the weight 402 that can be attached to the device 10C. The weight 402 can be in any increment such as a quarter-pound, half-pound, three-quarter pound, one pound, two pounds, three pounds, four pounds, five pounds, etc. The weight 402 can be made of any material such as, but not limited to, metal, plastic or rubber. A coil spring 424 can be wrapped around the weight 402. The spring 424 can have retaining clips 420 at each end of the coil spring 424. The retaining clips 420 are capable of forming a diameter that will allow the weight to be snapped into place on the outer tubular shaft 12C or the telescoping shaft 18C. The coil spring 424 and the weight 402 can be coated with a coating 426. The coating 426 can be a rust proof coating such as but not limited to a rubber or plastic type of coating. This could allow the user to use the exercise device in inclement weather such as rain or snow without worrying about the weights becoming rusted.

Figure 39:
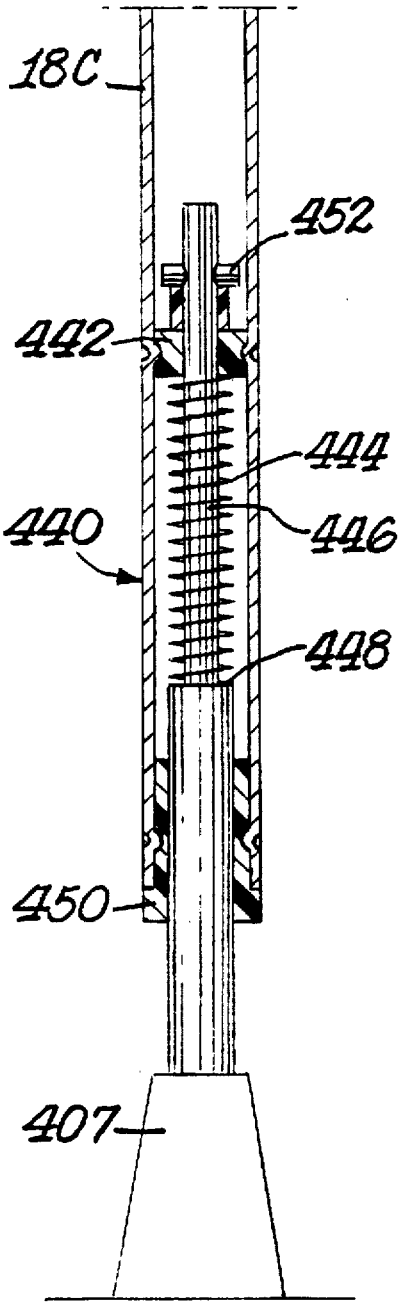
FIG. 39 shows a side elevational view of shock absorbing mechanism shown in FIG. 33 not in the engaged position.

FIG. 39 shows a shock absorbing embodiment according to this invention. The shock absorbing mechanism 440 would contain a bushing 442, a compression spring 444 a stem 446 a shoulder 448 and a lower sleeve 450. The exterior of the telescopic shaft 18C can be peened in at least two locations as shown in FIG. 39. The bushing 442 can also be peened so as to be locked into the stationary position inside the peened portion of the outer shaft 18C. Compression spring 444 would fit underneath the peened bushing 442 and on top of the shoulder 448. The telescopic shaft 18C can also have a lower peened surface which would also have a sleeve or a bushing 450. The position from the peened parts of the pole would remain the same. FIG. 39 shows the device 10C in the rest position and not engaged on the ground. The spring 444 is in the rest position and not compressed.

Figure 40:
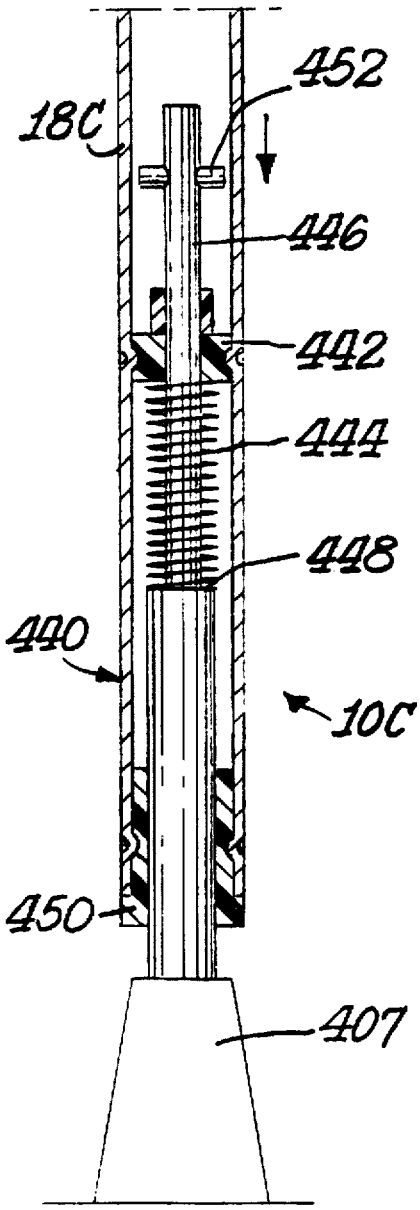
FIG. 40 shows a side elevational view of the shock absorbing mechanism shown in FIG. 33 in the engaged position.

FIG. 40 shows the lower section device 10C being used by a user pushing down on the device. The tip 452 is engaged on the ground surface and the force pushing down on the device 10C causes the compression spring 444 to compress and pushes the shoulder 448 up and also pushes the stop pin 452 up. The telescoping shaft 18C would move down on the shoulder 448. The tip 452 would remain on the ground. Again, the position from the peened parts of the pole would remain the same whether or not the spring is compressed and the telescoping shaft 18C has been lowered by the force exerted by the user when planting the pole on the ground surface. The pole can be placed at an angled position between about 15° to about 180° so that when a user places the device at an angle, the device can be about perpendicular to the ground and the user can push off on the device at an angle greater than 90° and then the device would spring back to the rest position as sown in FIG. 39.

Figure 41:
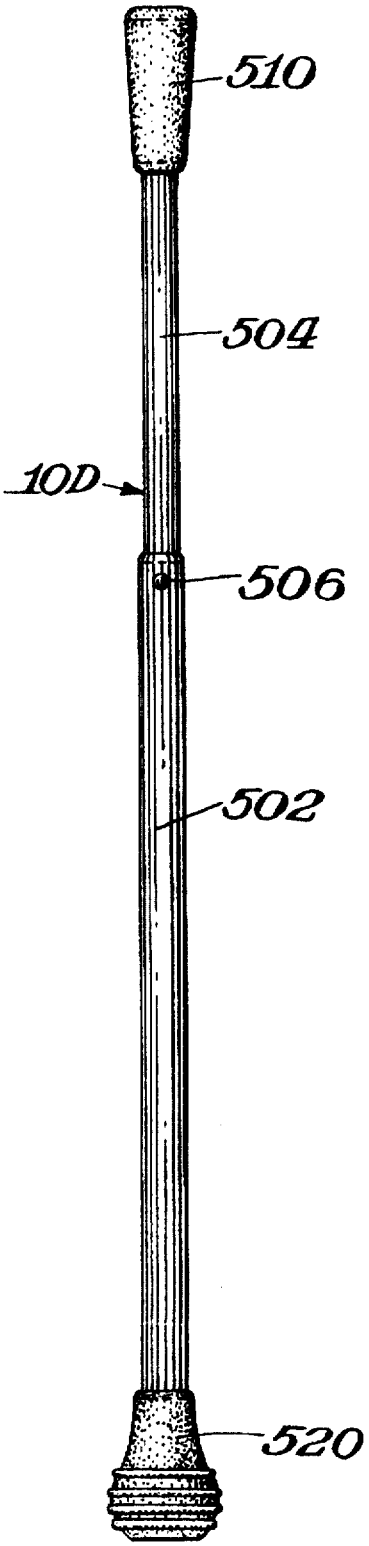
FIG. 41 shows a side elevational view of a further embodiment of an exercise device in accordance with this invention.

FIG. 41 shows a side elevational view according to the exercise device according to this invention. The exercise device 10D could have at least one shaft 502. It can also have an additional shaft 504. The shafts can be connected by a breakdown means 506. The breakdown means 506 would enable the shafts to either be completely separated or folded in half. On top of the upper shaft 504 would be a handle 510. The handle 510 can be made of any resilient material, thereby allowing the user to get a comfortable while using the exercise device 10D. At the bottom of the exercise 10D could be a tip 520. The tip 520 can be the same as any of the previous tips described above. The tip 520 could be made of a resilient material and can also be used to compress and push off the ground during exercising.

Figure 42:
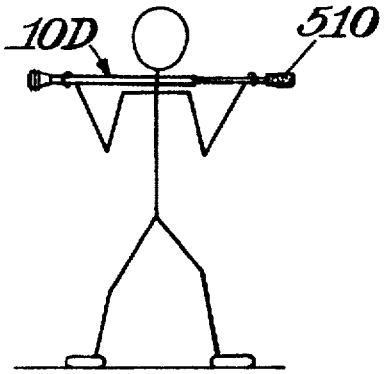
FIG. 42 shows a schematic view showing a user exercising with the exercise device in accordance with this invention.
Figure 43:
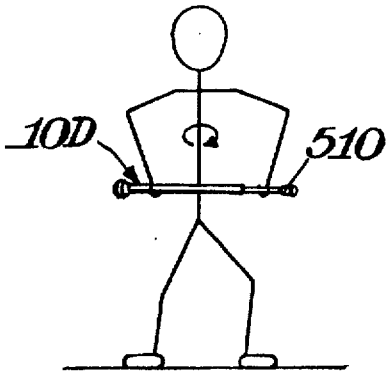
FIG. 43 shows a different schematic view showing a user exercising with the exercise device in accordance with this invention.

FIG. 42 shows a user exercising with the device 10D according to this invention. The user can do a number of different types of exercises as show in FIGS. 42 through 44. The user can do a twist exercise with the exercise device as shown in FIGS. 42 and 43. The user can place the exercise device in front or behind the user's shoulders (FIG. 42) or in front of or behind the user's waist (FIG. 43) and do a twisting motion (holding the exercise device with the users hands located one at each end of the device and twisting the users upper body (shoulders) and keeping the hips straight). The user can place the exercise device behind the user's shoulders and do squats or knee bends (FIG. 42) (the user starts in an erect position holding the exercise device with the user's hands located one at each end of the device and the user bends the user's knees while keeping upper body (back) straight.

Figure 44:
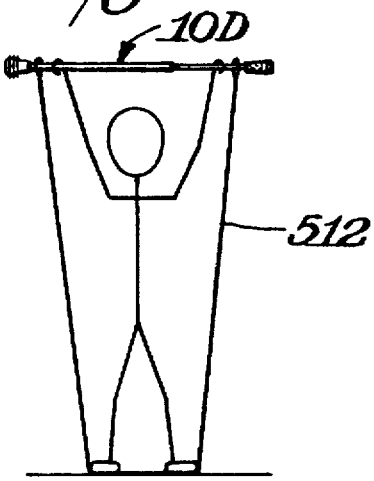
FIG. 44 shows a further schematic view showing a user exercising with the exercise device in accordance with this invention.

In addition, the user could additional exercises with attachments to the exercise device 10D. As shown in FIG. 44, the user can attach a resilient elastic cord 512 to the exercise device 10D. The cord 512 can be attached at two different locations on the exercise device 10D. Preferably, the cord 512 is adjustable such that the user can adjust the location of the cord 512 so that the user can stand on the cord 512 and have the ends of the cord 512 being attached at opposite ends of the exercise device 10D so that the user's hands when holding the exercise device would be inside the cords 512 when the user is exercising. The user can stand on the cord 512 and do deep knee bends or just pull the exercise device 10D above the user's head while creating greater tension in the cord 512. The user would hold the exercise device 10D in that position for the desired time and then bring the exercise device 10D lower the device 10D to the rest position (where the there is no more tension in the cord 512). The user could stand on the cord 512 at various locations to tighten the cord 512. Additionally, the user can tie the cord 512 into a knot also to create a greater tension since the cord 512 would be smaller in size.

The user can also perform step aerobics with the exercise device 10D. The user would perform the same exercises mentioned above, but would be able to do them on a stepping device. The user can also perform dance aerobics with the exercise device 10D.

The exercise device can be used for other body exercises when not walking, running or other motion exercises—i.e. for exercise at rest. The exercise devise can be adjustable or non-adjustable and can have a good comfortable grip, cushion tip and optionally clip on weights. The exercise devise can be used in a various floor exercises, stepping exercises, and dancing. In addition, the exercise device can have at least one or more elastic cords that can be clipped/snapped onto the exercise device at various positions. Various resistance exercises can then be done such as, but not limited to:

1) arm curls,
2) leg squats,
3) shoulder shrugs,
4) bench presses,
5) rowing,
6) leg presses or
7) arm presses The cords can also be clipped at either or both ends of the pole. The cords can be stored easily, such as inside hollow handles that screw on the top of the shaft. The ends of cord can additionally be attached to the shaft by loops or clips.

Weights can be added or subtracted in a number of ways to the poles, for a progressive exercise program, and more or less exercise.

The shaft or shafts can be hollow, as to be able to be filled with cylindrical weight slugs, such as are used in weighted vests.

Interchangeable weights can be screwed or snapped on to vary weight. Forms of such weights are ball feet, or cylindrical weighted bottoms. These variable weight pieces could be of any size or shape.

Although screw threads are illustrated as the preferred means of attachment, other attaching means may be used such as friction connection or interlocking parts.

It is to be understood that various features shown for specific embodiments can be used with other embodiments. Similarly the outer shaft 12 can be disposed at the top shaft or as the lower shaft in the various embodiments.

Also the invention relates to a method of storing or carrying at least one walking stick comprising inserting at least one walking stick inside a sling, quiver, or carrying case or attaching a strap to said walking stick. The walking stick can easily be stored and transported in a sling, quiver, or carrying case or a strap can be attached to the walking stick. The exercise devise can also be broken down into sections preferably at least two sections of equal or not equal length, so that it can be easily stored.

The basic components of the pole are:

a) One or more shaft sections—if there is more than one shaft section, these can fit together by screwing or pressure fit. The shaft section would have at least one bend or at least one off-set in the section. One section can telescope into the other, for easy carrying or storage. A spring pin and hole telescoping mechanism can be used to adjust the length of the pole for different activities, and/or different size people. The pole can be non-adjustable (if there are one or more shafts in particular, if there is one shaft). The pole can also be adjustable in length—the length of the pole(s) can be varied by a variety of mechanisms such as, but not limited to:

a) telescoping, spring pin and hole,
b) telescoping, screw/clamp ring collar,
c) two or more sections that screw or pressure fit together,
d) one or more sections joined by a folding hinge,
e) twist and lock mechanism or
f) screw through the inner and outer shaft.

The purpose of adjustable length is for different sports, size people, compactness for carrying or storage. The pole can be easily adjustable in height by alignment marks, line or mark going vertically down the inner shaft. Again, the pole can also be a single non-adjustable shaft. It is also possible that the poles have the following additional features:

1) Adjustable Weight (Amount)—The weight of the poles can be varied by adding weight in a number of ways:

a) placing weights inside hollow poles or handles;
b) placing weights on the poles or handles. Weights can be screwed, clipped, clamped, hooked or pinned onto the shafts/handles. Magnetic weights can be placed on the shafts. Doughnut-type weights can be slid onto the shaft and "stacked";

c) weights can be screwed or pressure fitted onto the tops or bottoms of the shaft and handles. Screw-off feet of different sizes can be used to vary the weight of the shafts.

Varying the amount of weight allows the user to engage in a progressive exercise program and adjust the "feel" of the poles.

The weights can also be designed to be moveable up and down the shaft, instead of only being in one fixed position. This produces a "metronome" effect that permits the user to vary the feel, swing rate, and wrist/arm torque required to move the poles. Again, weights can be positioned using a variety of attachment means including screw clamping, wrapping with a velcro strap, or sliding up and down in a slot along the shaft.

One excellent way to adjust the position of the weight, is to have doughnut-shaped weights that slide up and down the pole. The weights are coated with a soft substance such as rubber or vinyl to prevent scratching the poles. The diameter of the "doughnut" holes is about the same as the outside diameter of the poles, so that the weights will "pressure fit" around the pole, so much that they will not slip when being used, but that with force they can be moved up and down for adjustment purposes.

The weights can range from half a pound increments up to 15 pounds and preferably from 1 pound up to 5 pound increments.

To aid the user in balancing the weight equally on each pole, colored/lettered or numbered hash marks are placed on each pole for reference. These also serve to identify the level of placement for the degree of exercise.

2) Handle or padded grip—the grip can have a detachable decorative knob at the top. The grip also has molded plastic guards above and below the hand to prevent slippage. The preferable embodiment would have the grip being made of a resilient foam. A wrist or hand strap is attached to the handle to allow for a relaxed grip, and to prevent poles from being dropped.

3) Permanent or detachable foot—the foot has a non-slip rubber base for traction. A set of interchangeable detachable feet can create a multipurpose pole(s). In addition in another embodiment the foot can be a curved sided foot having a flat bottom and curved side which can contact the ground. The base or the edge side contacts the ground. Alternatively the edge of the foot where the side joins the bottom can be either pointed or preferably, curved. When the pole and the foot are tilted at an angle less than 90° the preferred embodiment of the foot is that the sides of the foot are convex shaped or outwardly curved to promote contact with the ground. Additionally the curve side surface of the foot can have nubs, grooves, or other non-slip formations on the surface to promote traction.

Different feet attachment for: walking, trash pickup, spear fishing, a pick for rough terrain or mountain climbing, golfing, etc.

4) Wrist Strap—A wrist strap is attached to the upper part of the shaft or handle, that allows and open or relaxed grip on the handle. In addition, it acts as a guard against losing a pole by dropping it.

5) Safety bands/colors—Bright fluorescent colors/bands are used on the poles for day and night safety.

6) Dumbbell grip—The handles can be a dumbbell/hand weight that converts to a grip by one or both ends screwing off, and one end screwing onto the top of the shaft. Thus the dumbbell handle can convert to a pole/grip handle, and/or a weighted handle and a back strap can serve as a grip strap.

7) Adjustable, padded carry strap, sling or case—Means to carry the poles when not in use is also part of the invention. The poles can be carried in one hand, off the waist, on the shoulder, or slung across the back. An adjustable length, padded strap with velcro ties on each end, is a handy way to carry the poles when not in use, or hang them up for storage at home or in a gym. Another good way is a sheath, with an adjustable, padded carry strap.

8) Electronics package—which can include, for example, a means for instantly finding out the day/date, time, distance traveled (kilometers or miles), a pulse meter, a stopwatch, an alarm, hourly beeper, countdown timer and a light (similar to a sport watch); am/fm radio; am/fm cassette player; a beeper; a compact disc player or any other battery operated device including a small TV set.

9) Temperature regulated handle—which can include heater coils inside the handle which is activated by a switch. The heated handle would be advantageous for winter time use. The handle also can be hollow in which cold packs can be stored inside the handle. This would be advantageous for summer time use.

10) Flashlight—which can be stored in the tip of the walking stick. The flashlight would consist of batteries, a bulb and reflector, and a lens. The flashlight could emit either a continuous beam or a blinking beam.

11) Resilient Handgrip Handle—which would allow the user to strengthen the users hands while using the walking sticks of this invention.

12) Beeper built into the handle—which would allow the user to press the button in the grip of the handle engaging (turning the beeper on). The beeper can omit a high pitched sound which could chase animals such as dogs away from the user.

While there is shown and described herein certain specific structure embodying the invention, it will be manifest to those skilled in the art that various modifications and rearrangements of the parts maybe made without departing from the spirit and scope of the underlying inventive concept and that the same is not limited to the particular forms herein shown and described.

I claim:

1. An exercise pole device comprising:

a) at least one shaft having an upper and lower end, b) a handle connected to the upper end of said shaft, c) a reducing means connected to said shaft which enables the pole to be reduced in size for easy transportability, d) a compressible tip which makes contact with a ground surface said tip grips the ground while in use and prevents slippage, said tip is remote from said handle attached to the lower end of said shaft said tip comprises a series of different size annular rings and ground enhancing ribs, and e) said exercise device being of sufficient length whereby said exercise device has said handle attached to a top end of said device and said handle is capable of being gripped by user's hand and a bottom end of said device which touches a ground surface.

2. The exercise device as claimed in claim 1, which additionally comprises a cord having two ends, with at least one end of the cord attached to said pole.

3. The exercise device as claimed in claim 2, wherein one end of said cord is attached to said device and the other end of said cord is attached to a different object.

4. The exercise device as claimed in claim 2, wherein one end of said cord is attached to said device and the other end of said cord is attached a user.

5. The exercise device as claimed in claim 2, wherein one end of said cord is attached to said device and the other end of said cord is attached a belt on a user.

6. The exercise device as claimed in claim 2, wherein both ends of the cord are attached to said pole.

7. A method of exercising which comprises a user standing on the cord of the exercise device as claimed in claim 6, and the user grips the exercise device with the user's hands, and pushes the exercise device away from the user thereby creating tension on said cord, then the user brings the exercise device to the original position thereby reducing the tension in the cord.

8. A method of exercising which comprises a user moving the exercise device as claimed in claim 2 away from the user creating tension in said cord, wherein one end of said cord is attached to said device and the other end of said cord is attached a user and then said user brings the exercise device back to the original position thereby reducing the tension in the cord.

9. The exercise device as claimed in claim 1, further comprising a weight which is attached to said pole.

10. The exercise device as claimed in claim 9, wherein said weight is attached at the top of said pole, middle of said pole, bottom of said pole or inside said handle.

11. The exercise device as claimed in claim 10, wherein the weight is a donut shaped weight attached to the middle of said pole.

12. The exercise device as claimed in claim 1, further comprising a removable tip at the bottom of said pole.

13. The exercise device as claimed in claim 1, further comprising a tip connected to said bottom end of said pole wherein said tip is selected from the group consisting of a ski pole, hiking pick, shock absorber tip, ball weight frogging gaff, fishing gaff and golf club attachment.

14. The exercise device as claimed in claim 1, further comprising an electronics package which contains at least one of the following components selected from the group consisting of a clock, stopwatch, a pedometer, a pulse meter, an hour chime, an alarm, a light, a day/date mechanism, a beeper which can omit a high pitch sound, am\fm radio, am\fm cassette, cassette, and compact disc player.

15. The exercise device as claimed in claim 1, wherein said handle is made of a resilient material and further has an adjustable strap attached to said handle.

16. The exercise device as claimed in claim 15, further comprising cords stored in said handle.

17. The exercise device as claimed in claim 1, wherein there are two shafts, an inner and outer shaft, wherein said inner shaft has a smaller outer diameter than the inner diameter of said outer shaft, and said inner shaft fits inside said outer shaft, and is telescopically adjustable.

18. The exercise device as claimed in claim 17, further comprising a non-slip foot attached to the bottom of end of said inner shaft by means of a spring mechanism that allows said inner tubular shaft to move in a downward direction when the user applies force to said pole when said pole is in contact with the ground surface.

19. The exercise device as claimed in claim 17, wherein said outer tubular shaft and said inner shaft are detachably mounted and stored as separate members in a carrying case.

20. The exercise device as claimed in claim 1, wherein said pole is fully collapsed and stored in a carrying case.

21. The exercise device as claimed in claim 17, further comprising at least one adjusting means attached to either the inner shaft or outer shaft or both that adjusts the angle of said inner or outer shaft whereby the pole is capable of being bent in several different possible positions.

22. The exercise device as claimed in claim 1, wherein said exercise device is adjustable in length to fit persons of different height so that one set of exercise device is universally applicable to all persons.

23. The exercise device as claimed in claim 17, wherein said adjustment means is a screw wherein said screw is screwed inside said outer and said inner shaft at the desired location.

24. The exercise device as claimed in claim 23, further comprising a visible alignment mark or line on the outside of said inner shaft or said outer shaft.

25. A method of storing at least one exercise device as claimed in claim 1, which comprises collapsing or taking apart said exercise device and then inserting said exercise device inside a sling, quiver, or carrying case or attaching a strap to said exercise device.

26. A method of exercising which comprises swinging the exercise device as claimed in claim 1, in a back and forth direction with each hand.

27. A method of exercising comprising a user gripping the exercise device as claimed in claim 1, with each hand and performing floor exercises while using said pole.

28. The method as claimed in claim 27, wherein said floor exercises are selected from the group consisting of:

1) arm curls,
2) leg squats,
3) shoulder shrugs,
4) bench presses,
5) rowing,
6) leg presses,
7) arm presses,
8) twisting,
9) toe raises,
10) dancing, and
11) step aerobics.

29. A method of carrying at least one exercise device as claimed in claim 1, which comprises inserting said exercise device inside a sling, quiver, or carrying case.

30. An exercise pole device comprising:

a) at least one shaft having an upper and lower end,
b) a spherical shaped handle connected to the upper end of said shaft,
c) a reducing means connected to said shaft which enables the pole to be reduced in size for easy transportability,
d) a compressible tip which makes contact with a ground surface said tip grips the ground while in use and prevents slippage, said tip is remote from said handle attached to the lower end of said shaft, and
e) said exercise device being of sufficient length whereby said exercise device has said handle attached to a top end of said device and said handle is capable of being gripped by user's hand and a bottom end of said device which touches a ground surface.

31. The exercise device as claimed in claim 1, wherein said annular rings go around the middle of the surface to the bottom of the surface and make contact with the ground.

32. The exercise device as claimed in claim 1, wherein said handle is made of a resilient material such that the user would be able to perform hand strengthening exercise by gripping the handle tightly and releasing said handle and then regripping it.

33. A method of exercising comprising a user swinging an exercise device in a back and forth direction with each hand while wearing body weights, said exercise device comprises a) at least one shaft having an upper and lower end, b) a handle connected to the upper end of said shaft, c) a reducing means connected to said shaft which enables the pole to be reduced in size for easy transportability, d) a ground contacting surface remote from said handle attached to the lower end of said shaft, and e) said exercise device being of sufficient length whereby said exercise device has said handle attached to a top end of said device and said handle is gripped by user's hand and a bottom end of said device which touches a ground surface.

34. The exercise device as claimed in claim 30, wherein said tip comprises a series of different size annular rings and ground enhancing ribs.

* * * * *